LARYNGOSCOPE INCLUDING A LATERALLY OFFSET BLADE

The present invention relates generally to a laryngoscope and more particularly to a laryngoscope comprised of a conventional or standard handle and a specifically designed non-standard blade engagably connectable with the handle in a laterally offset operating position.

As used herein, the "standard laryngoscope" refers to the one specifically illustrated in FIGS. 1 and 2, generally designated by the reference numeral 10. This laryngoscope includes a handle 12 having an elongated, straight hand gripping segment 14, and a blade connecting head segment 16 extending up from the uppermost end 18 (FIG. 2) of segment 14. This laryngoscope also includes a blade 20 separate from the handle and having a handle connecting back segment 22 and an elongated, slightly curved tongue lifting and endotracheal tube guiding front segment 24 extending out from segment 22. As seen best in FIG. 2, segment 16 includes a pair of spaced apart support flanges 26 extending up from the uppermost end 18 of hand gripping segment 14. A blade supporting pin 28 (FIG. 1) is connected to and between these flanges near the front, top end of the latter. The handle connecting back segment 22 of blade 20 includes a front jaw-shaped section 30 defining a slot 32 (FIG. 1) and a rearward base 34 (FIG. 2). Blade 20 is disengagably connected to handle 12 by engaging the slot 32 around support pin 28 and thereafter rotating base 34 into its FIG. 2 position between flanges 26. While not shown in FIGS. 1 or 2, the flanges 26 and base 34 include cooperating means for maintaining blade in its operating position.

In addition to the components thus far described, standard laryngoscope 10 includes a power supply, e.g. one or more batteries (not shown), contained within hand gripping segment 14 of handle 12 and an electrical contact 35 located at the uppermost end of and carried by segment 14 along the elongation axis 46 of the latter. At the same time, blade 20 carries its own light source 36, e.g. a light bulb, at the front end of the segment 24 and a contact 38 electrically connected to the light source by means of a conduit contained lead wire 40. Contact 38 is carried by base 34 on the underside of the latter in a position so as to engage contact 35 when the blade is placed in its operating position. This closes an electrical circuit between the power supply in handle 12 and the light source so as to cause the latter to energize.

As best illustrated in FIG. 2, the tongue 24 of blade 20 may be separated into laterally adjacent subsegments 42 and 44 extending its entire length. Subsegment 42 is located in a plane extending through the elongation axis 46 of hand gripping segment 14 and serves to lift the patient's tongue and guide an endotracheal tube into the throat of a patient. Subsegment 44 which is disposed laterally to one side of subsegment 42 serves to contain lead wire 40. This positional relationship between the subsegments 42 and 44 and the rest of the laryngoscope has certain drawbacks. First, it should be noted that subsegment 42 is what may be considered the working subsegment of the blade in that it is used to physically guide the endotracheal tube into the patient's throat, as stated. Since this subsegment is in direct line with the handle's hand gripping segment, it is located relatively close to the user's hand, actually his wrist when properly gripped, as best illustrated in FIG. 6. This makes it more difficult for the user to manipulate the endotracheal tube along the guiding surface of subsegment 42. Another disadvantage of this positional relationship resides in the desire to replace the light source 36 at the front end of blade 20 with a light guide and relocate the light source in base 34 directly over contact 38, as will be seen hereinafter. With the particular positional relationship between subsegments 42 and 44 and base 34, this requires that the light guide be bent a number of times. Specifically, in order for the rearwardmost end of the light guide to be placed in optical communication with a relocated light source, it would have to be bent downward (FIG. 1) and thereafter to the left and then again downward, (see the dotted lines in FIG. 2).

In view of the foregoing, it is one object of the present invention to provide a laryngoscope including a handle and a blade which is disengagably connectable with the handle in a laterally offset manner so as to place its working surface (e.g., its endotracheal tube guiding surface) further from the user's grip when the laryngoscope is held in a normal operating position.

Another object of the present invention is to provide the last-mentioned laryngoscope with a standard laryngoscope handle.

Still another object of the present invention is to provide the last-mentioned laterally offset blade with a light source at its rearward handle connecting end and a light guide extended therefrom to the front end of the blade, all of which, except for a forwardmost end section of the light guide, are disposed in a common plane extending through the elongation axis of the handle when the blade is in its operating position on the handle.

As will be seen hereinafter, the overall laryngoscope disclosed herein includes a standard handle of the type described above, specifically one which includes an elongated, straight hand gripping segment containing a battery or batteries and a blade connecting head segment extending up from the uppermost end of the hand gripping segment as well as the previously described electrical contact 35 located on the axis of the hand gripping segment. The laryngoscope also includes a separable blade having a handle connecting back segment and a tube guiding front segment as well as first and second cooperating means respectively forming parts of the head segment of the handle and the handle connecting segment of the blade for disengagably connecting the blade in an operating position to the handle.

In accordance with one aspect of the present invention, the handle connecting segment of the blade carries means including a light source and its own electrically connected contact in a location which places this latter contact and the light source over and directly adjacent contact 35 such that the contacts engage one another and thereby energize the light source. A light guide is carried by the tube guiding segment of the blade and has a rearwardmost end in optical alignment with the light source and forwardmost end section. This light guide, with the exception of its forwardmost end section, is disposed within a single plane which extends through the elongation axis of the handle's hand gripping segment when the blade is in its operating position and therefore it is not required to be bent outside of this plane.

In accordance with another aspect of the present invention, the tongue of the blade just recited includes laterally adjacent first and second subsegments extending its entire length. The first of these subsegments is disposed within the plane of and serves to contain the FIG. 1
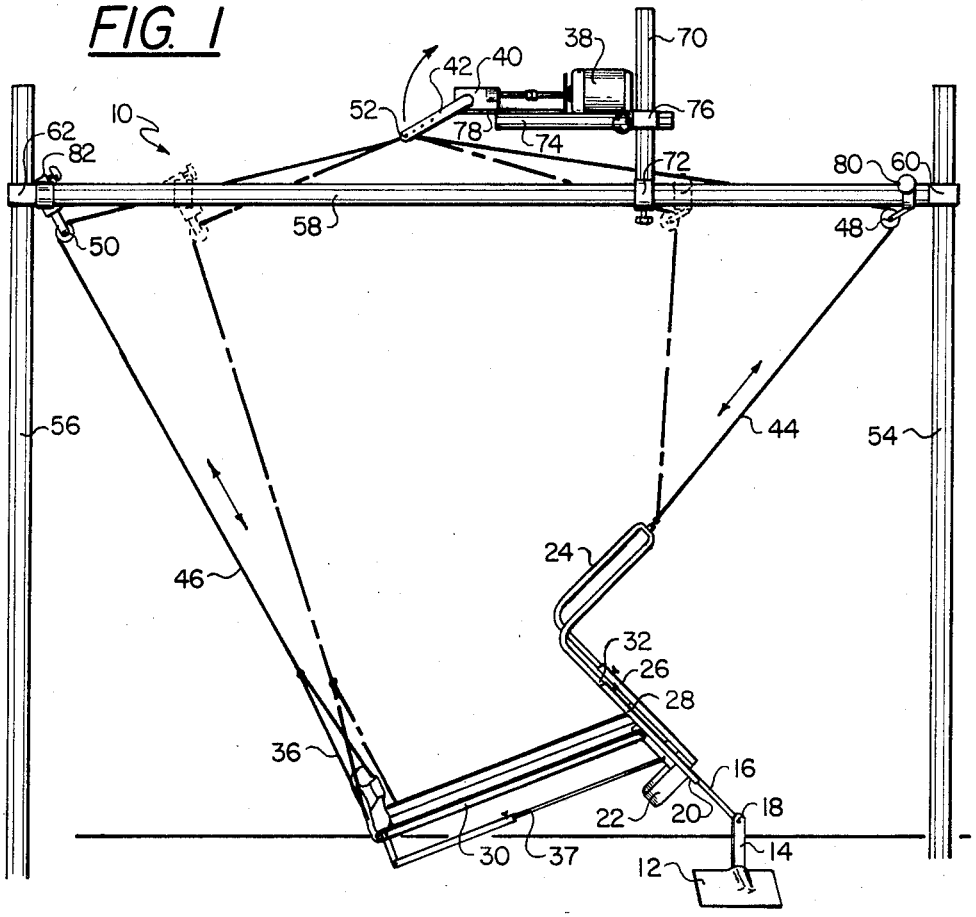
FIG. 4
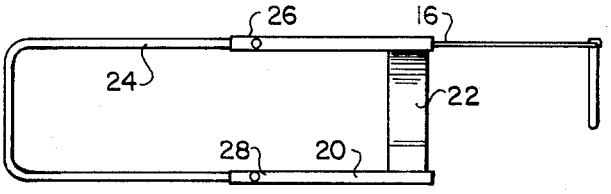
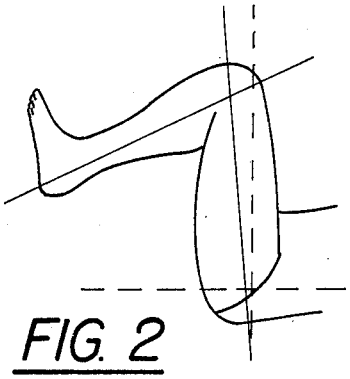
FIG. 2
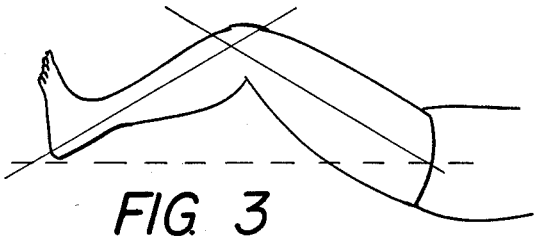
FIG. 3

CONTINUOUS PASSIVE MOTION METHOD AND APPARATUS

REFERENCE TO RELATED APPLICATION

The present application is a continuation-in-part of my co-pending application, Ser. No. 319,646, filed Nov. 9, 1981, entitled Continuous Passive Motion Machine, now abandoned.

BACKGROUND OF THE INVENTION

The present invention relates to methods and apparatus for improving recovery of patients from surgery and pertains particularly to a continuous passive motion method and apparatus for application to the limbs of a patient.

Some studies have been conducted in an effort to determine the effect of continuous passive motion on the healing of certain operations and conditions. Some investigations have indicated that continuous passive motion appears to facilitate cartilage healing.

Some devices have been constructed for the purpose of applying continuous motion to the limbs of an individual particularly the legs. Some of these studies have been conducted by the use of a motorized stationary bicycle which applies a motion to the legs of the patient. Such studies have indicated some beneficial results from the motion, however, such studies have also resulted in complaints of pain as a result of the mechanism for applying the motion.

A continuous passive motion device has been developed by one company which supports a leg on an articulated linkage support device and applies a motion to one end of the linkage for applying a continuous motion to the leg. This mechanism, however, has the disadvantages of being difficult to match patient limb segment lengths to the device which reduces its applicability to a continuous use, difficult to achieve an adequate degree of knee flexion and it runs too slowly.

One area of application of continuous passive motion is in the area of knee surgery particularly to total knee surgery where the knee has been completely replaced by a prosthesis. One of the most significant problems with such patients following surgery is that of the need to relieve postoperative pain and to restore motion to the limb.

Another area of application is to patients who have undergone hip surgery. Still other operations and injuries are believed to be potential beneficiaries of continuous passive motion.

The prior art methods and mechanisms to achieve continuous passive motion have not been satisfactory for this purpose.

It is therefore desirable that a method and apparatus be available for the application of a continuous passive motion to the limbs of postoperative surgery patients.

SUMMARY AND OBJECTS OF THE INVENTION

It is therefore the primary object of the present invention to provide an improved method and apparatus for the application of continuous passive motion to the limbs of an individual.

In accordance with the primary aspect of the present invention a continuous motion apparatus includes a linkage support mechanism having a first support member for supporting the thigh limb and a second support member for supporting the lower limb with adjustable linkage means selectively adjustably connected to the separate support members and to drive means for selectively adjusting the range, speed, and extent of motion.

BRIEF DESCRIPTION OF THE DRAWINGS

The above and other objects and advantages of the present invention will become apparent from the following description when read in conjunction with the drawings wherein:

FIG. 1 is a perspective view of a preferred embodiment of the apparatus.

FIG. 2 is a side elevational view showing a position of flexion of a leg.

FIG. 3 is a side elevation view of the leg of FIG. 2 showing a position of extension.

FIG. 4 is a top plan view of the thigh support view member.

DETAILED DESCRIPTION OF A PREFERRED EMBODIMENT

Figure 5:
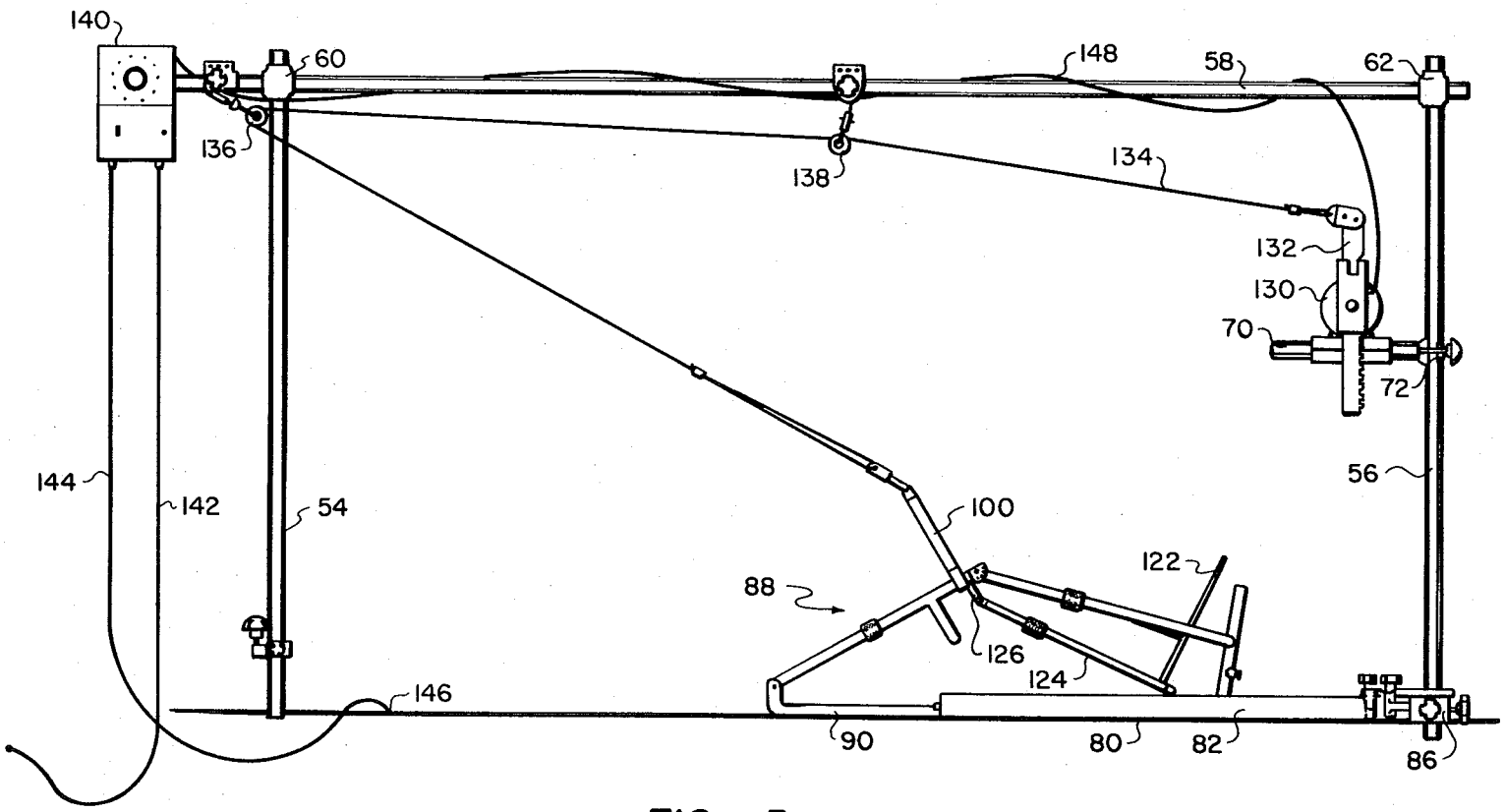
FIG. 5 is a side elevation view of an alternative embodiment.

Turning to the drawings there is illustrated in FIG. 1 an apparatus in accordance with the invention designated generally by the numeral 10 which comprises a base plate 12 having an upwardly extending arm 14 to which a thigh support segment of member 16 is pivotally connected at pivot 18 for pivotal motion about the pivot points thereof. The plate 12 may be a part of a larger plate that may be supported on a bed or table. This thigh support structure includes a main body portion or bar 16 for extending along one side of the thigh, and a parallel bar 20 extending along the other side of the thigh with a U-shaped strap 22 extending between the bars 16, 20 and beneath the thigh.

An adjustable leg lifting extension bracket 24 is telescopically mounted on the outer end of the thigh support member extending out beyond the knee and for serving as an attachment or connection for the drive mechanism. This extension 24 is formed of a rod structure shaped to form two parallel L-shaped members telescopically mounted in tube clamps 26 and 28 on bars 16 and 20.

A lower leg support segment or member 30 is an elongated splint-like structure having an inner end and an outer end pivotally attached at the inner end to selected positions proximate the knee to the outer end of upper leg support members at a pivot axis which is selectively adjustable in position by pivot pins 32 and 34 to correspond with the pivot or rotary axis of the knee. This lower leg support member extends downward and includes a foot plate or stirrup 36 pivotally mounted thereon for receiving the foot. The foot plate 36 is connected by an adjustable length link 37 to the thigh support member near the knee to give passive oscillating motion to the foot for flexing the ankle as the support structure moves.

A drive assembly for this apparatus includes a motor 38 having a suitable reduction drive gearing 40 and a drive arm 42. The drive arm 42 is preferably adjustable by a plurality of pivot pins, for example, to adjust the length of the crank arm and extent of the motion in the apparatus. The speed of the motor 38 is preferably adjustable or variable to adjust the speed of motion of the apparatus. A range of ½ RPM to 5 RPM is considered desirable.

A flexible link such as cables or ropes 44 and 46 are connected at one end to the respective support members and each extend around direction changing pulleys 48 and 50 and the other end thereof connected to the drive crank 42 by a pin 52 of the drive apparatus. The flexible link 44 is connected to the lift bracket 24 on the outer end of the thigh support member 20 for raising and lowering the outer end thereof as the crank arm 42 rotates. The flexible link 46 is connected to the outer end of the lower leg support member and acts as guide means to guide the outer end of the lower leg support member in a pre-determined path. The drive apparatus may include one or more cranks such that each of the drive links 44 and 46 may be selectively connected to the same or to separate crank drive arms. The advantage of a single drive arm 42 as illustrated is the ability to adjust a continuous related motion in the apparatus. The crank arm is adjustable by selected positions of the crank pin to adjust the extent of the various motions.

The drive apparatus is supported on an overhead rack or frame assembly which can be positioned directly over a bed, table or the like. This frame structure includes a pair of vertical posts 54 and 56 with a vertically adjustable horizontal bar 58 secured by clamps 60 and 62 to the vertical posts 54 and 56. A vertical post 70 is secured by a clamp 72 to bar 58 and supports a bar 74 secured thereto by a clamp 76. The motor 38 may be attached such as by plate 78 to the bar 74 by bolts. The various clamps permit adjustment in the position of the motor and pulleys.

The position of the direction change pulleys 48 and 50 may be changed to also change the range of the motion of either or both of the upper leg support member or the lower leg support member. The pulleys 48 and 50 may be selectively connected to suitable overhead structure such as the above described rack or frame which is typically available in most hospitals. These pulleys 48 and 50 are attached by clamps 80 and 82 which permit selecting the desired position thereof as shown in phantom in FIG. 1. The motor may be clamped directly to the overhead support member 58 or to either of the uprights 54 and 56 and appropriately connected to a suitable power source. The motor 38 may be variable speed or a reduction drive may be utilized for selectively adjusting the respective drive speed.

Various motions with positions of the leg such as illustrated in FIGS. 2 and 3 may be induced in the limb of the patient. For example, movement of the position of the direction changing pulleys, such as shown in phantom can adjust the respective position and relative motion between the two members of the leg support structure. This results in an adjustment in the positioning of the movement arc as well as the extent of the arc. The amount and extent of flexion and extension of the leg can be adjusted such as shown in FIG. 2. The amount of flexion can be up to about 120 degrees. The extension of the leg can also be adjusted such as shown in FIG. 3. This can also be done by adjustment in rope length without changing the pulley position. The extent of the motion arc is determined solely by the length of lever arm crank 42.

For example the linkages can be adjusted such that the primary motion is solely in the knee, a situation that may sometimes be desirable where knee surgery has occurred. Similarly, the linkages can be adjusted such that the motion is primarily in the hip, if such were desired, such as where hip surgery has occurred. Similar adjustments can be made to vary this combination with a selected motion for any particular joint or limb. Both the range of motion and arc of motion can be easily changed with this apparatus.

Figure 6:
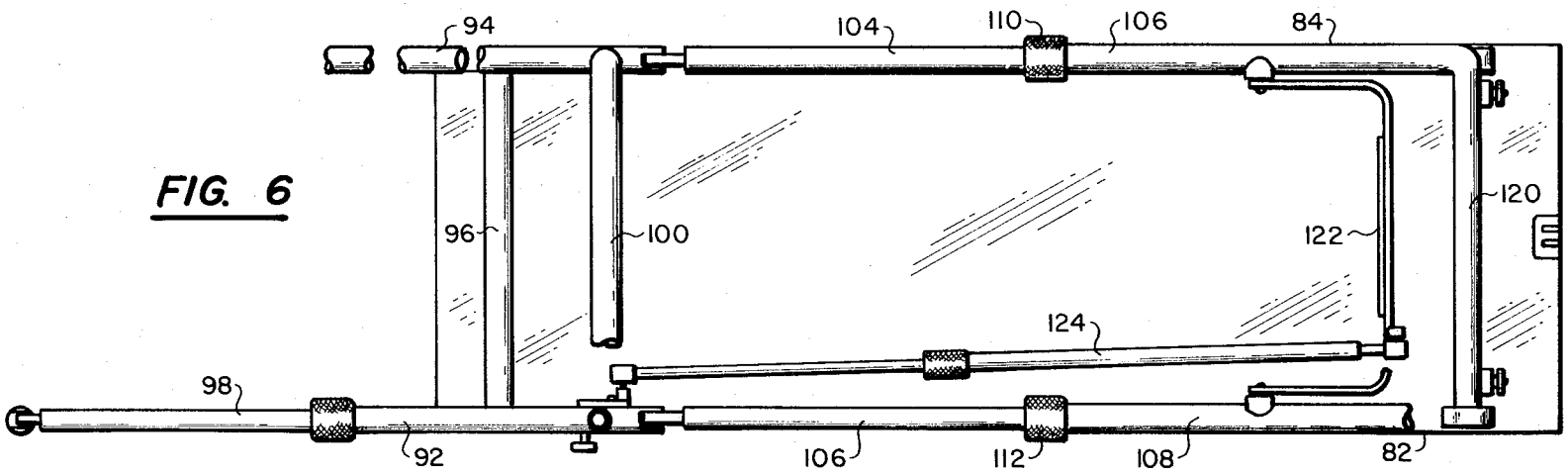
FIG. 6 is a top plan view of the leg support unit of the embodiment of FIG. 5.
Figure 7:
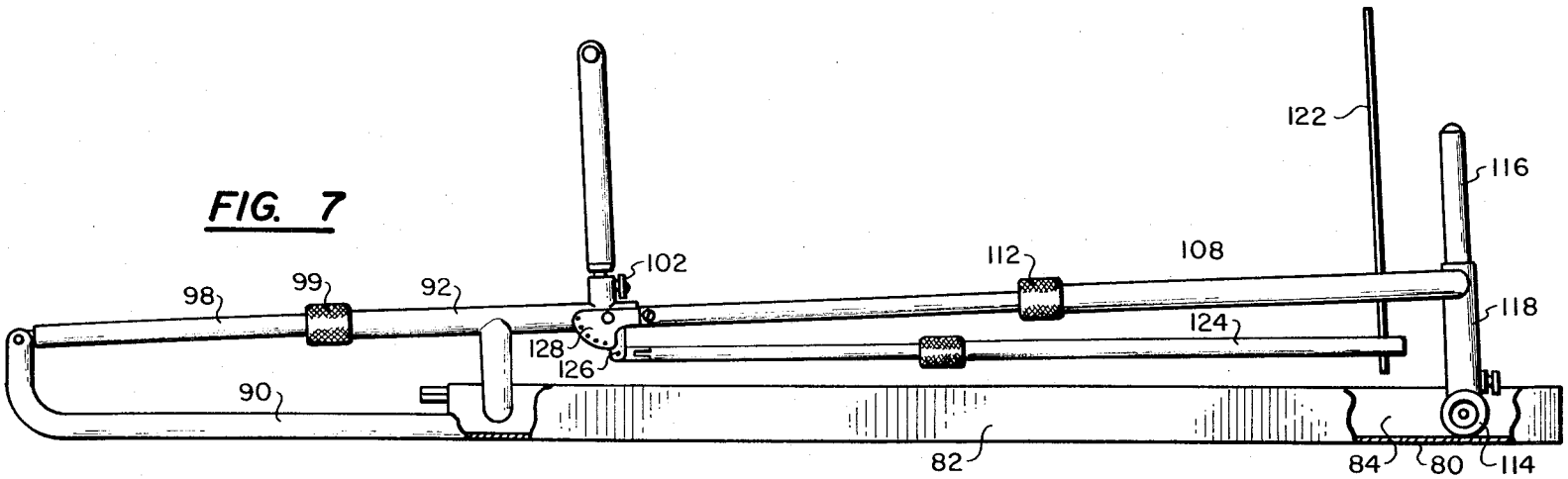
FIG. 7 is a detailed side elevational view of the leg support unit with portions broken away to reveal details.

Referring to FIGS. 5 through 7 of the drawings alternate embodiment of the invention which utilizes a single flexible linkage and a different guide means for the outer end of the lower leg support member is illustrated. This embodiment is illustrated in FIG. 5 in an arrangement with an overlying support frame such as in FIG. 1 with like members identified by the same reference numerals.

The leg support unit of the FIGS. 5 through 7 embodiment comprises a base support member or plate 80 of a generally flat rectangular configuration having a pair of upwardly extending parallel sidewalls 82 and 84 defining a guide track as will be explained. A clamp 86 clamps the base 80 to a bed or other frame structure. The basic leg support structure is substantially the same as in the previous embodiment but with some refinements. In this embodiment a thigh support bracket 88 is pivotally attached at the inner end thereof to a pivot bracket 90 attached to the base frame or support 80. The thigh support member comprises a generally telescoping tubular frame having a pair of parallel tubular members 92 and 94 with a crossmember 96 connecting them together for extending beneath the thigh. One of the parallel tubular members 92 and 94 telescopically receives a pivot telescoping member 98 that is secured in its position by tube clamp 99 and pivotally attached at one end to the bracket 90. The arrangement can be arranged for either right or left leg by the positioning of the bracket 90 and tubular member 98 to either side of the base support member 80 by means of detachable brackets on the base 80 not specifically illustrated. The tube 98 would be telescopically clamped into either tube 92 or 94 by a tube clamp. A leg lifting bracket 100 is of a generally U-shape configuration and connected as shown in FIG. 7 by detachable pins 102 to the frame members 92 and 94 of the thigh support bracket.

A lower leg support member comprises a pair of upper tubular members 104 and 106 pivotally connected to the tubular members 92 and 94 of the thigh support bracket. These upper tubular members are telescopically received in lower tubular members 106 and 108 and are secured in a selected extended position by suitable tube clamps 110 and 112.

The outer end of the lower leg support member is supported by a pair of rollers, only one of which 114 is shown mounted on the lower end of a vertically telescoping tubular member 116 which is mounted in a vertical tubular leg 118 and may be adjustable vertically therein.

A foot plate 122 is pivotally mounted by arms at opposite sides thereof to the side rails or frame members 106 and 108. A link member 124 which is adjustable in length by a telescoping tubular construction is pivotally connected to the lower edge of the foot plate 122 and to an arm 126 mounted on the tubular member 92 of the thigh support frame or member. The arm 126 is pivotally mounted to the tubular frame member 92 and is secured in place by pins to an arcuate plate 128 having pins for positioning the arm 126 in various angular positions relative to the frame member 92 thereby varying the length of the arm which actuates the link member 124 and thereby the foot plate 122. The foot plate can be varied in oscillation from zero up to 60 degrees of oscillation for thereby flexing the ankle during flexing of the leg.

The leg support structure is driven by an arrangement of a motor 130 of a variable speed having a variable length crank arm 132 connected by a flexible line of rope 134 through at least one pulley 136 and connected to the leg lifting bracket 100 which is attached directly to the thigh support frame member 88. A motor timer and speed control unit 140 is connected by a conductor 142 to a source at power, and a conductor 144 to a patient control switch 146, and conductor 148 to motor 130.

In operation a leg support unit as shown in FIG. 7 is selected and mounted on a suitable table or bed and connected by the clamp assembly 86 to a suitable structure including the bed or an overhead framework as illustrated. The bed or table is arranged with an overhead support structure as illustrated on which is mounted the drive motor, the pulleys and the drive link. The leg support frame structure is then adjusted to the length of the patient's leg with the leg then positioned and strapped in the support structure. Appropriate adjustments are made for the desired motion by various adjustments including adjustment of the foot plate or the proper ankle motion adjustment of the length of the crank arm on the drive motor for the range of the excursion of the motion, and the positioning of the pulleys for also controlling the range of motion. The motor 130 is connected to a suitable motor time and speed control 140 for selecting and controlling the speed of the motor.

Studies which I have conducted indicate that continuous passive motion during recovery does improve the degree and/or range of motion or flexion as opposed to noncontinuous passive motion. These studies also indicate signficant postoperative pain relief.

The data from these studies were plotted on a graph to show a comparison of the flexion resulting from continuous passive motion as compared to a controlled group of patients where continuous passive motion was not applied. The curves indicated the flexion degree that was available to patients wherein continuous passive motion was applied. This test was conducted with continuous passive motion applied by means of either a motorized bicycle or a splint combination which I devised.

It has also been found from the facts that pain was significantly reduced as the result of the application of certain degree of continuous passive motion. A study was made of the pain for a control group of patients having no continuous motion applied, as compared to patients for which a continuous motion was supplied. It was found that the pain level was reduced somewhat for those having the continuous motion applied.

In my method of postoperative treatment by the application of continuous passive motion, I select continuous motion drive apparatus having separate adjustable linkage means for separately connecting to separate pivotal support members for the thigh and calf respectively of the leg. A flexible linkage such as rope or cable is selected and separately connected to the support member and to a selected radius on the crank arm for the desired range of motion. The direction of force or pull by the linkage is selected by selectively positioning one or more pulleys. The rate or speed of motion is selected by either motor or gear box speed. The leg or limb is placed in the support members and may be secured by straps or bandage but usually not and the motion initiated by energizing the motor. Selected duration of the motion can be utilized as desired.

While I have illustrated and described my invention by means of specific embodiments it is to be understood that numerous changes and modifications may be made therein without departing from the spirit and scope of the invention as defined in the appended claims. For example, the method and apparatus of the present invention has utility as a treatment modality for the postoperative rehabilitation of total knee patients, and a variety of other orthopedic conditions in both the upper and lower extremities.

Having now described my invention I now claim:

1. A continuous passive motion recuperative apparatus, said apparatus comprising:
   - a base member;
   - an adjustable thigh support member having an inner end and an outer end, said inner end being pivotally attached to said base member for pivotal movement about said inner end thereof;
   - a lower leg support member having an inner end and an outer end and pivotally connected at the inner end to the outer end of said thigh support member; and
   - guide means for guiding the outer end of said lower leg support member; and
   - continuous drive means including linkage means comprising an elongated flexible link of adjustable length connected at one end of said thigh support member and at the other end to a continuously moveable drive member for inducing a selected continuous motion thereof for flexing one or more joints of a leg.

2. The motion apparatus of claim 1 wherein said linkage means comprises a flexible link of adjustable length.

3. The apparatus of claim 1 wherein said drive means comprises a motor that is variable speed.

4. The apparatus of claim 2 wherein said drive means includes a variable length crank and said link is connected to said crank.

5. The apparatus of claim 4 comprising direction changing pulley means supporting said flexible link between the ends thereof and selectively positionable for changing the direction of force of said link on said support members.

6. The apparatus of claim 1 wherein said guide means comprises:
   - track means; and
   - roller means on the outer end of said lower leg support member engaging said track means.

7. The apparatus of claim 1 wherein said support members each comprises adjustable means for selectively adjusting the length of said support members.

8. The apparatus of claim 7 wherein said drive means includes a reduction drive unit.

9. The apparatus of claim 7 wherein said drive means includes an adjustable radius crank arm and said linkage means includes direction changing pulley means.

10. The apparatus of claim 6 wherein said track means is defined by a generally flat rectangular plate having parallel side walls, and
   - said roller means comprises a vertical support leg secured to the outer end of said lower support member and having a roller mounted on the lower end thereof.

11. The apparatus of claim 5 comprising an overhead support bar extending generally parallel to said support member for supporting said pulley means.

12. A continuous passive motion recuperative apparatus, said apparatus comprising:

a base member;

an adjustable thigh support member having an inner end and an outer end and being pivotally supported at said inner end to said base member for pivotal movement about said inner end thereof, a lower leg support member having an inner end and an outer end and being pivotally connected at said inner end to the outer end of said thigh support member;

guide means for guiding the outer end of said lower leg support member; and drive means including a variable throw crank, a variable speed motor for driving said crank, adjustable length flexible linkage means connecting the outer end of said thigh support member to said crank, for inducing a selectable continuous range of motion in said thigh and lower leg support members.

13. The apparatus of claim 12 wherein said guide means comprises a plate having side walls, and a pair of rollers on the outer end of said lower leg support member engaging said plate.

14. The apparatus of claim 12 wherein said drive means includes an overhead support bar and at least one pulley means thereon and said linkage is connected through said pulley to said crank arm for providing selectable range of motion at said first and second support members.

15. The apparatus of claim 13 including direction changing pulley means selectively positionable for changing the direction of motion of said linkage on said support members.

16. The apparatus of claim 15 wherein said support members are pivotally connected to each other at an adjustable pivot point for adjusting the length of at least said first support member.

17. A method of improving the rate of postoperative healing in a limb of a patient, comprising the steps of:

selecting supporting means for supporting upper and lower limb members;

selecting variable speed continuous drive means for driving said support means;

connecting said drive means to said supporting means by variably positionable flexible linkage means; and activating said drive means for applying a continuous passive motion to said supporting means for applying a continuous passive motion to a limb member in said supporting means.

18. The method of claim 20 including selectively adjusting the degree of flexion and extension of said limb.

19. The method of claim 18 wherein said limb is a leg of a patient.

* * * * *

UNITED STATES PATENT AND TRADEMARK OFFICE

CERTIFICATE OF CORRECTION

PATENT NO. : 4,546,763

DATED : October 15, 1985

INVENTOR(S) : RICHARD D. COUTTS

It is certified that error appears in the above-identified patent and that said Letters Patent is hereby corrected as shown below:

Claim 18, delete "20" and insert therefor --17--.

Signed and Sealed this

*Fourth* Day of *February 1986*

[SEAL]

*Attest:*

DONALD J. QUIGG

*Attesting Officer*

*Commissioner of Patents and Trademarks*